US005467600A

United States Patent [19]

Kuroiwa

[11] Patent Number: 5,467,600

[45] Date of Patent: Nov. 21, 1995

[54] NATURALLY CIRCULATED THERMAL CYCLING SYSTEM WITH ENVIRONMENTALLY POWERED ENGINE

[76] Inventor: Kazuo Kuroiwa, 8-18-16, Shirane, Asahi-ku, Yokohama-shi, Kanagawa, Japan

[21] Appl. No.: 991,099

[22] Filed: Dec. 16, 1992

[30] Foreign Application Priority Data

Dec. 26, 1991 [JP] Japan ..... 3-361304

[51] Int. Cl.[6] ..... F02G 1/04

[52] U.S. Cl. ..... 62/6; 417/399; 60/650

[58] Field of Search ..... 62/6; 60/641.1, 60/641.2, 641.6, 641.8, 517, 519, 650, 680; 417/399

[56] References Cited

U.S. PATENT DOCUMENTS

| | | | |
|---|---|---|---|
| 3,101,596 | 8/1963 | Rinia et al. | 62/6 |
| 3,174,276 | 3/1965 | Baker | 60/24 |
| 3,457,722 | 7/1969 | Bush | 60/24 |
| 4,077,221 | 3/1978 | Maeda | 60/650 |
| 4,353,212 | 10/1982 | Adler | 60/622 |
| 4,397,155 | 8/1983 | Davey | 62/6 |
| 4,455,826 | 6/1984 | Knoos | 60/526 |
| 4,642,988 | 2/1987 | Benson | 60/641.14 |

*Primary Examiner*—Henry A. Bennet
*Assistant Examiner*—William C. Doerrler
*Attorney, Agent, or Firm*—Cumpston & Shaw

[57] ABSTRACT

A thermal cycling system comprising an evaporator and a radiator and two separate conduits extending between the evaporator and the radiator to form a closed cycle. The evaporator is arranged to receive thermal energy available around the evaporator and the radiator radiates heat of the fluid medium flowing from the evaporator to the radiator. A power-free engine is arranged on the first and second conduits and comprises actuating pistons, at least one pressurizing cylinder, and a crankshaft operatively interconnecting the actuating pistons and the pressurizing piston. The arrangement is such that the actuating pistons are moved by the high pressure of the fluid medium in the evaporator and thereby actuate the pressurizing piston. The high pressure fluid medium is controlled such that it flows through the actuating cylinders to the radiator and radiates heat there at. The fluid medium having a low temperature and low pressure is then pumped up by the pressurizing piston, which is actuated by the actuating pistons.

25 Claims, 13 Drawing Sheets

NATURALLY CIRCULATED THERMAL CYCLING SYSTEM WITH ENVIRONMENTALLY POWERED ENGINE

BACKGROUND OF THE INVENTION

1. Field of the Invention

The present invention relates to a naturally circulated thermal cycling system, and in particular, the present invention relates to a thermal cycling system having an environmentally powered engine for circulating a fluid medium between a hot location and a cool location, for example, between the ground level where solar energy is available and the underground level where the temperature is relatively low.

2. Description of the Related Art

In general, a hot fluid, especially a gaseous fluid, fundamentally rises upwardly, and it is difficult to naturally deliver the hot gaseous fluid from a high location such as ground level to a low location such as an underground level. Accordingly, it has been necessary to use a power-operated fan or the like for forcibly delivering the hot gaseous fluid from a high location to a low location. In addition, it has been necessary to use a power-operated fan or the like for lifting the liquid fluid from a low location to a high location. Therefore, a considerable amount of power is consumed.

In a conventional thermal cycling system, such as a Rankine cycle system, the liquid fluid is heated so as to evaporate to a superheated gas in a boiler or an evaporator, then expanded, and condensed. The liquid fluid is then delivered to the boiler or the evaporator by a power-operated pump and again heated to repeat the cycle. Also in this case, a conventional thermal cycling system consumes a large amount of power.

SUMMARY OF THE INVENTION

The object of the present invention is to provide a thermal cycling system in which a gaseous fluid medium can be naturally delivered between a hotter location and a cooler location where the heat can be used or stored, using environmentally available energy such as solar energy, atmospheric energy, by-product heat, thermal energy, wind or water powered energy, and other sources, but in any event nondirectly fossil fuel powered, thereby ensuring a clean environment.

Another object of the present invention is to provide a thermal cycling system in which a gaseous fluid medium can be naturally delivered from a higher location to a lower location at which heat is used or stored, thereby ensuring a clean environment.

Still another object of the present invention is to provide a thermal cycling system including a environmentally powered engine for delivering a hot gaseous fluid medium from a first location to a second location and for returning the cooled gaseous fluid medium from the second location to the first location.

These objects are attained by a thermal cycling system according to the present invention. The thermal cycling system has a compressible fluid medium contained in the system and comprises an evaporator adapted to receive thermal energy existing around the evaporator so as to evaporate the fluid medium therein to a first temperature and a first pressure; a radiator adapted to radiate heat of the fluid medium therein to a second temperature lower than the first temperature and a second pressure lower than the first pressure; first and second separate conduit means interconnecting the evaporator and the radiator, and a environmentally powered engine arranged on the first and second conduit means for delivering the fluid medium from the evaporator to the radiator through the first conduit means and from the radiator to the evaporator through the second conduit means. The environmentally powered engine comprises: at least three actuating cylinders each having an actuating piston accommodated therein, an inlet valve connected to a portion of the first conduit means extending to the evaporator, and an outlet valve connected to a portion of the first conduit means extending to the radiator; at least one pressurizing cylinder having a pressurizing piston accommodated therein, an inlet valve connected to a portion of the second conduit means extending to the radiator, and an outlet valve connected to a portion of the second conduit means extending to the evaporator; and a rotatable body means operatively interconnecting the at least three actuating pistons and the at least one pressurizing piston; whereby at least one actuating piston is moved in one direction by the first pressure of the fluid medium acting on at least one actuating piston against one of the first and second pressures acting on at least one pressurizing piston to draw the fluid medium from the evaporator into the actuating cylinder when the inlet valve of the actuating cylinder is opened, and in the opposite direction by the first pressure of the fluid medium acting on at least one actuating piston to output the fluid medium from the actuating cylinder to the radiator when the outlet valve of the actuating cylinder is opened; the pressurizing piston being moved by at least one actuating piston via the rotatable body means in one direction to draw the fluid medium from the radiator into the pressurizing cylinder when the inlet valve of the pressurizing cylinder is opened and in the opposite direction to output the fluid medium from the pressurizing cylinder to the evaporator when the outlet valve of the pressurizing cylinder is opened.

In this arrangement, the evaporator can be located, for example, at ground level and receives thermal energy, for example, solar energy, which is clean and infinitely available, and the fluid medium evaporates to a superheated gas. The radiator can be located, for example, at the underground level and radiates heat of the fluid medium therein, so that the heat is utilized or stored thereat.

In the power-free engine of the system, at least one actuating piston is moved by the first pressure of the fluid medium in the evaporator and the fluid medium is controlled and delivered by at least one actuating piston from the evaporator to the radiator. The at least one pressurizing piston follows the movement of at least one actuating piston via the rotatable body means and the fluid medium is controlled and delivered by the pressurizing piston from the radiator to the evaporator. A part of the solar energy is used for moving the pistons and a part of the solar energy is delivered underground. By adequately determining the ratio of stroke volume per time of the at least three actuating pistons to that of at least one pressurizing piston, it is possible to continuously repeat the cycle in a desired manner.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
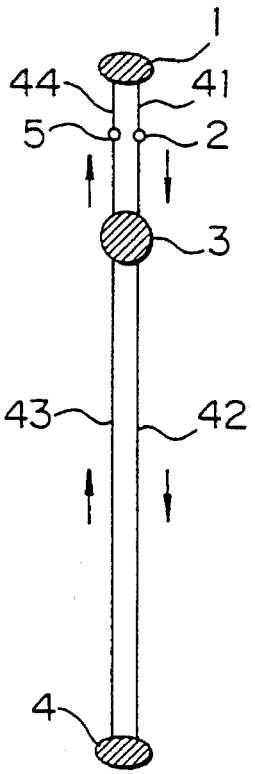
FIG. 1 is a diagrammatic view of a thermal cycling system according to the first embodiment of the present invention.

FIG. 1 shows the first embodiment of the present invention in which hot thermal energy at a high location is transferred to a low location. In particular, this embodiment is directed to receive heat emitted from a refrigerator apparatus or solar energy heat existing at ground level and store the heat underground.

In FIG. 1, the thermal cycling system comprises an evaporator or a heat collector 1, a radiator or a condenser 4, and a environmentally powered engine 3 that is called an Earcroys engine by the inventor. The thermal cycling system further comprises a first inlet pipe 41 for drawing the fluid medium from the evaporator 1 into the engine 3, a first outlet pipe 42 for outputting the fluid medium from the engine 3 into the radiator 4, a second inlet pipe 43 for drawing the fluid medium from the radiator 4 into the engine 3, and a second outlet pipe 44 for outputting the fluid medium from the engine 3 into the evaporator 1. The fluid medium is thus circulated in the direction of the arrows.

A flow control valve 2 is arranged in the first inlet pipe 41 and an accessory element 5 in the second outlet pipe 44. The accessary element 5 comprises at least one of a receiver tank, a filter, a purger of non-condensible gas, a drier, a safety valve, and a window. The size and position of these elements are suitably selected, and these elements can be arranged in the other pipes 41 to 43.

Figure 3:
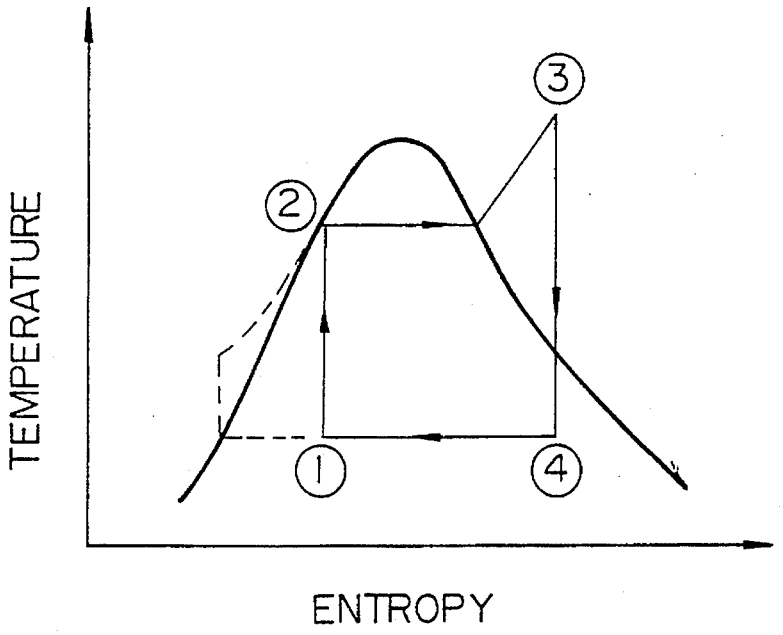
FIG. 3 is a diagram of an Earcroys cycle established by the present invention.

As shown in FIG. 3, the thermal cycling system of FIG. 1 operates in the illustrated cycle, which is called an Earcroys cycle by the inventor. The fluid medium is heated by the thermal energy around the evaporator 1 to evaporate to a gaseous fluid, as shown from point 2 to point 3 in FIG. 3, while entropy increases. The gaseous fluid medium absorbs heat at a temperature above the evaporation temperature of a wet gas and becomes a superheated gas of a first high temperature and a first high pressure. The fluid medium can be selected from various gases according to design, and when, for example, a dioxide carbon is selected, the first pressure in the evaporator 1 reaches an atmospheric pressure of approx. 66 atm. and the first temperature is above approximately 25° C.

This gaseous fluid medium is delivered to the radiator 4 via the flow control valve 2 and the engine 3, as shown from point 3 to point 4 in FIG. 3. The flow control valve 2 closes the cycle when the pressure drops below a predetermined value. The fluid medium acts on actuating cylinders 15 to 17 (FIGS. 5 and 6) of the engine 3, expanding at an expansion ratio predetermined from a range between zero percent and 100 percent. The expansion ratio is small in the case of FIG. 1, and large in the case of FIG. 2, in which a further working means is added to the system.

The gaseous fluid medium is radiated or condensed in the radiator 4 to a wet gas with a second low temperature and a second low pressure, as shown from point 4 to point 1 in FIG. 3. The second pressure in the radiator 4 will attain an atmospheric pressure of approximately 60 atm. and the second temperature is approximately 21° C. in the case of the above described dioxide carbon. The heat difference between the evaporator 1 and the radiator 4 is used partly to power-free engine and is partly stored underground.

As shown from point 1 to point 2 in FIG. 3, the gaseous fluid medium (including the wet gas) is drawn from the radiator 4 to the evaporator 1 via the engine 3. It is one of the features of the present invention that the gaseous fluid medium can be drawn from the radiator 4 into a pressurizing cylinder 14 (FIGS. 5 and 6) of the engine 3, which can be compared with the corresponding course of the Rankine cycle, shown by the broken line in FIG. 3, in which the fluid medium is liquefied and the liquid fluid medium is lifted by a pump or the like. According to the invention, it is possible to continuously repeat the cycle in a predetermined ratio of stroke volume per time, by lifting the gaseous fluid medium of the predetermined density from the radiator 4 to the pressurizing cylinder 14 of the engine 3. Accordingly, the difference between the density of the gaseous fluid medium in the first conduit means and the density of the gaseous fluid medium in the second conduit means is small, resulting in a small pressure loss in the circulating fluid medium. Therefore, it is possible to stably operate with small loss the thermal cycling system even if the difference in height, between a high location where the evaporator 1 is located and a low location where the radiator 4 is located, is large.

Figure 2:
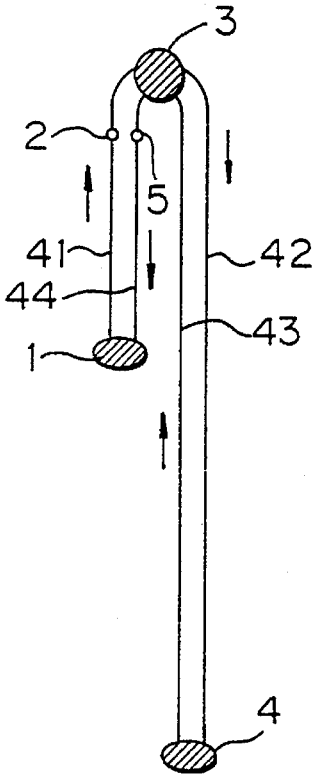
FIG. 2 is a diagrammatic view of a thermal cycling system according to the second embodiment of the present invention, including an electric generater sub-system.

FIG. 2 shows the second embodiment of the present invention, which includes elements similar to those of FIG. 1 except that the evaporator 1 is not necessarily located at a high location and the radiator 4 is not necessarily located at a low location. It is only necessary for the evaporator 1 to be located at a relatively hot location and the radiator 4 to be located at a relatively cool location. In addition, this embodiment further includes a generator sub-system as a further working means, which will be described later with reference to FIGS. 9 to 12. In this embodiment, the extent of the expansion of the gaseous fluid medium powering the engine 3 is selected to 100 percent and the generator is comprised of a permanent magnet type brushless generator and a plurality of such generators are operated in parallel formation so as to obtain a lot of high power.

Figure 5:
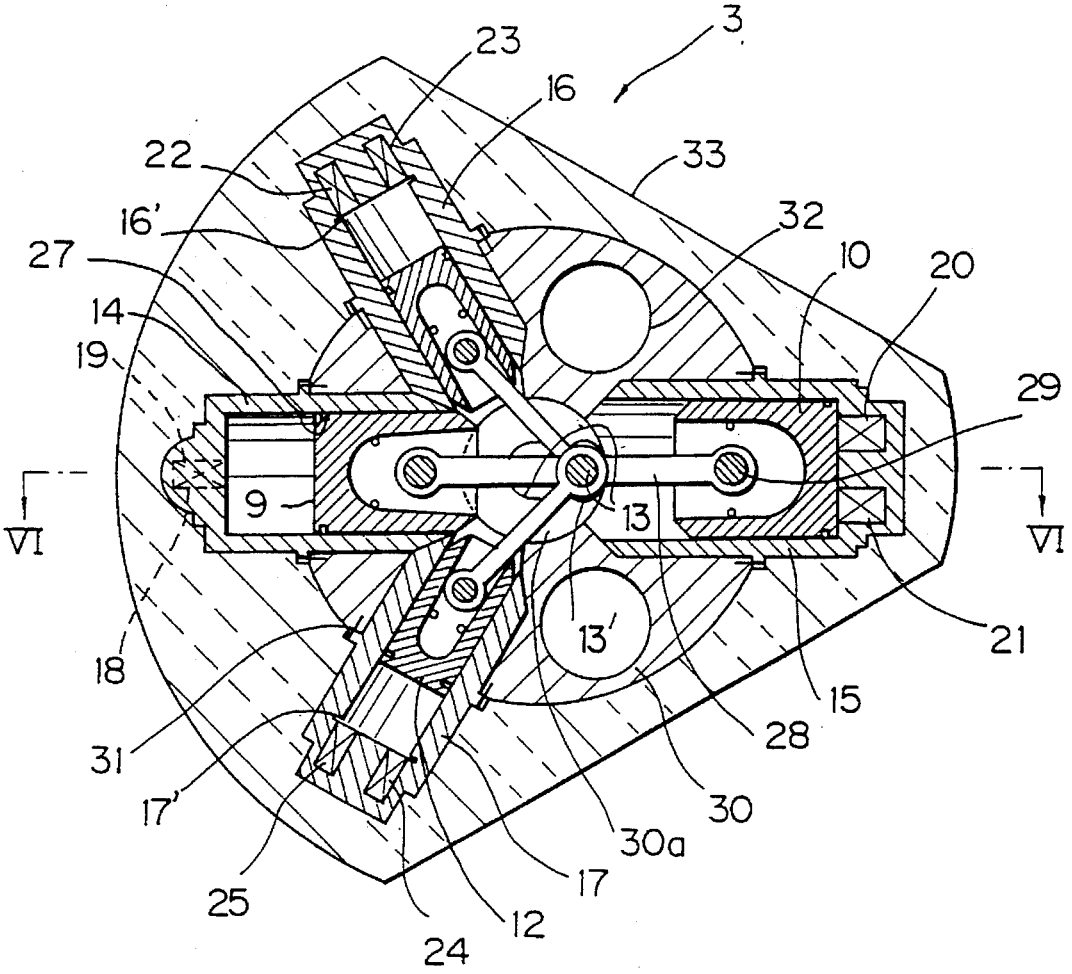
FIG. 5 is a cross-sectional view of the power-free engine called an Earcroys engine of FIG. 1, and taken along the line V—V in FIG. 6.
Figure 6:
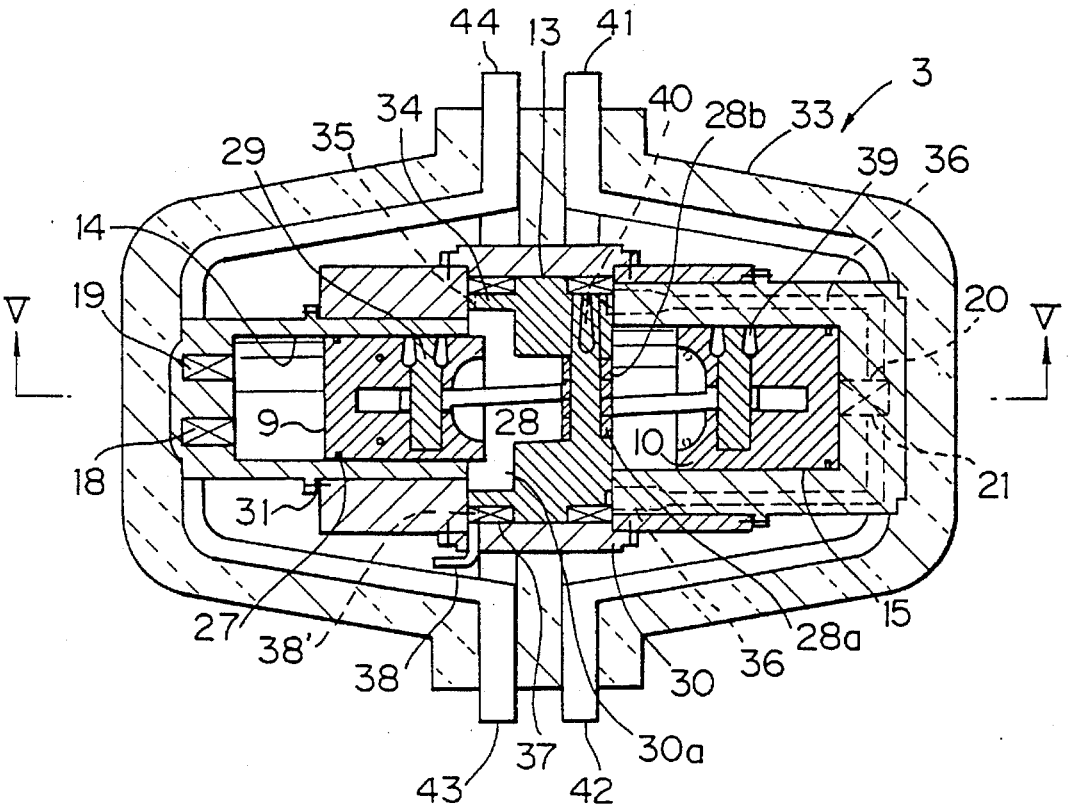
FIG. 6 is a cross-sectional view of the power-free engine of FIG. 5, taken along the line VI—VI in FIG. 5.

Referring to FIGS. 5 and 6, the environmentally powered engine 3 comprises a casing 30 having a crankshaft chamber 30*a*, three actuating cylinders 15 to 17 having actuating pistons 10 to 12 accommodated therein, respectively, and a pressurizing cylinder 14 having a pressurizing piston 9 accommodated therein. A piston ring 27 is attached to each of the actuating pistons 10 to 12 and the pressurizing piston 9.

A crankshaft 13 is arranged in the crankshaft chamber 30*a* and supported to the casing 30 by bearings 37. The actuating pistons 10 to 12 and the pressurizing piston 9 are connected to the crankshaft 13 via piston pins 29 and connecting rods 28, respectively. One of the actuating pistons 10 is arranged in an opposite relationship with the pressurizing piston 9 and all of the actuating pistons 10 to 12 are arranged equiangular to each other. In FIG. 6, the numerals 28*a* and 28*b* show the connecting rods of the remaining actuating pistons 11 and 12. The crankshaft 13 is designed to have an inertia mass like a flywheel to provide smooth rotation of the crankshaft 13.

The inner end of each of the actuating cylinders 15 to 17 and the pressurizing cylinder 14 is opened and in communication with the central crankshaft chamber 30*a*. The outer end of each of the actuating cylinders 15 to 17 and the pressurizing cylinder 14 has an inlet valve 20, 22, 24 or 18 and an outlet valve 21, 23, 25 or 19. The inlet valves 20, 22 and 24 of the actuating cylinders 15 to 17 are connected to the first inlet pipe 41 extending to the evaporator 1, and the outlet valves 21, 23 and 25 of the actuating cylinders 15 to 17 are connected to the first outlet pipe 42 extending to the radiator 4. The inlet valve 18 of the pressurizing cylinder 14 is connected to the second inlet pipe 43 extending to the radiator 4, and the outlet valve 19 of the pressurizing cylinder 14 is connected to the second outlet pipe 44 extending to the evaporator 1.

Figure 7:
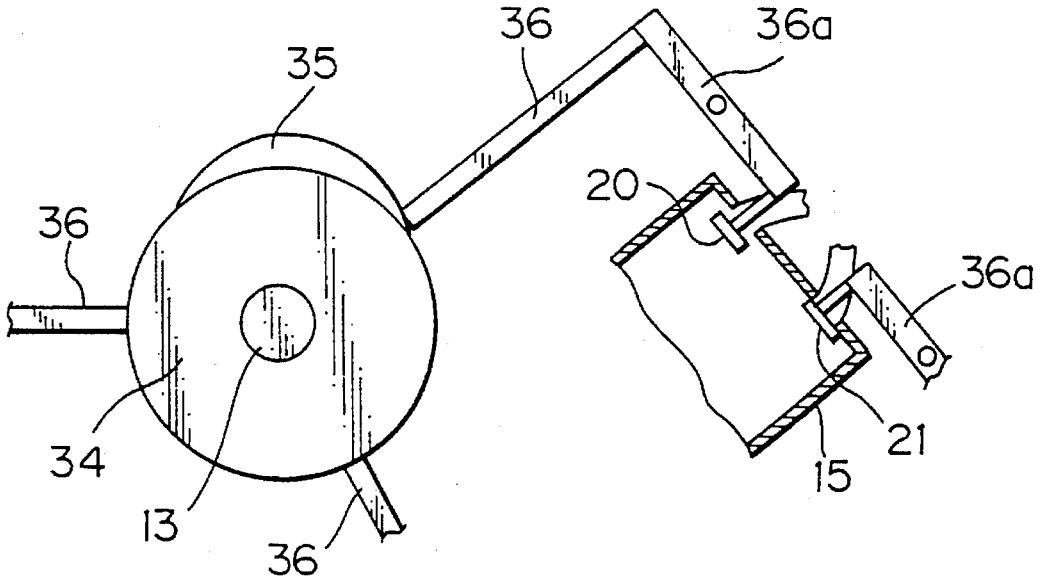
FIG. 7 is a detailed view of the valve arrangement of the actuating cylinder of FIGS. 5 and 6.
Figure 8:
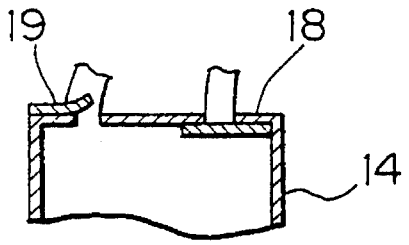
FIG. 8 is a detailed view of the valve arrangement of the pressurizing cylinder of FIGS. 5 and 6.

As shown in FIGS. 6 and 7, the crankshaft 13 has cams 34 on the opposite end portions thereof, and the cams 34 have lobes 35. Three plungers 36 are arranged around one cam 34 and are slidably inserted in the respective grooves in the casing 30. The plunger 36 extends between the cam 34 and one end of a rocker arm 36*a*, which extends between the plunger 36 and one of the inlet valves 20, 22 and 24 and the outlet valves 21, 23 and 25 of the actuating cylinders 15 to 17. Accordingly, the inlet valves 20, 22 and 24 and the outlet valves 21, 23 and 25 are opened and closed in according to the rotation of the crankshaft 13. The valve opening timing can be controlled by the lobes 35. As shown in FIG. 8, the inlet valve 18 and the outlet valve 19 of the pressurizing cylinder 14 are self-operable valves such as leaf valves, which open and close in response to the moving direction of the pressurizing piston 9.

Figure 4:
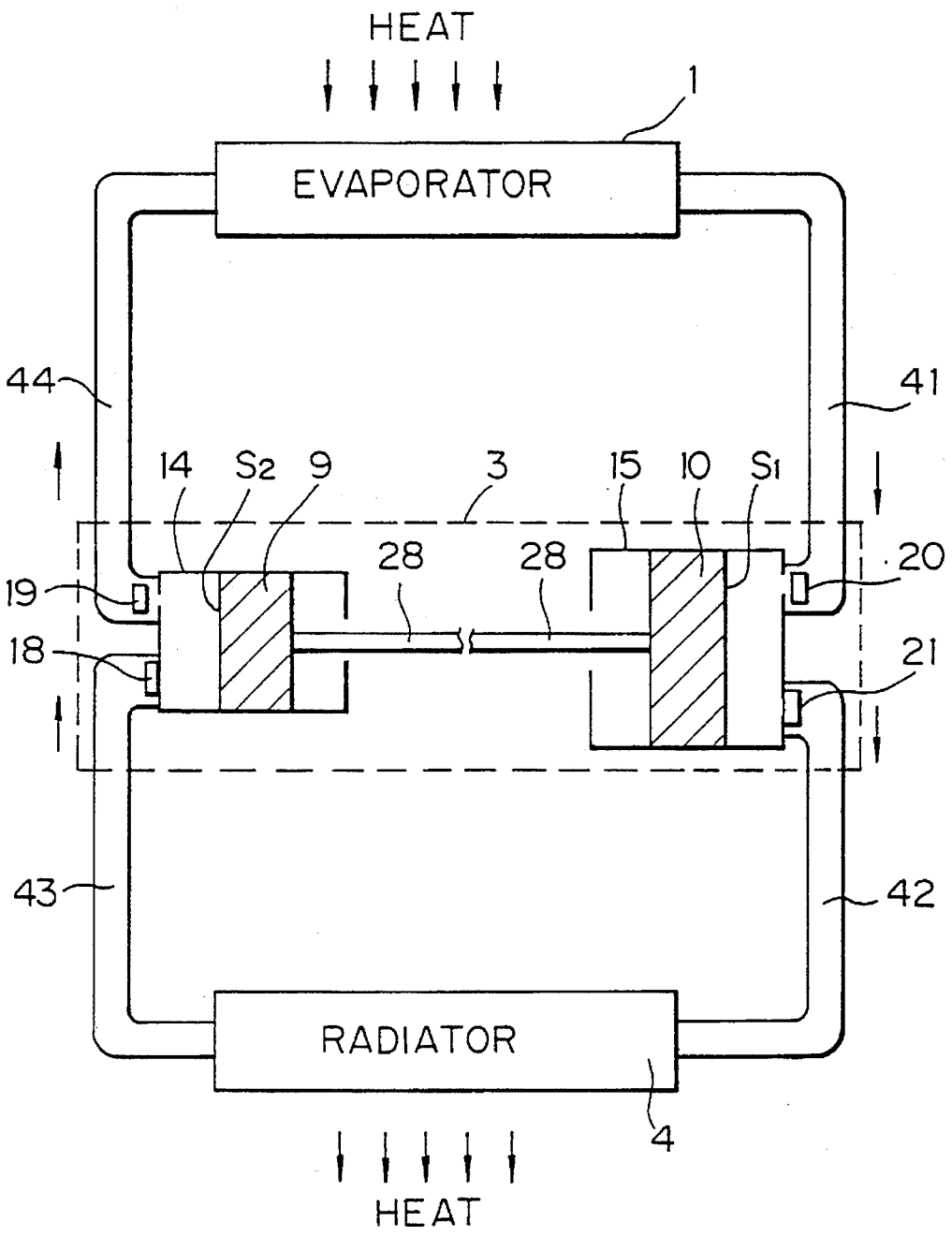
FIG. 4 is a diagrammatic view of the thermal cycling system, illustrating the principle of the present invention.

As diagrammatically shown in FIG. 4, the actuating piston 10 has a first cross-sectional area to define a pressure receiving surface $S_1$ and the pressurizing piston 9 has a second cross-sectional area to define a pressure receiving surface $S_2$ smaller than the first pressure receiving surface $S_1$. When the inlet valve 20 and the outlet valve 19 are opened, the pressure receiving surface $S_1$ receives the first pressure in the evaporator 1, and the pressure receiving surface $S_2$ also receives the first pressure in the evaporator 1. Due to the difference between the pressure receiving surfaces $S_1$ and $S_2$, the actuating piston 10 is moved in one direction by the first pressure of the fluid medium acting on the pressure receiving surface $S_1$ against the first pressure acting on the pressure receiving surface $S_2$.

Accordingly, the actuating piston 10 and the pressurizing piston 9 are moved to the left in FIG. 4. The fluid medium is drawn from the evaporator 1 into the actuating cylinder 15 through the first inlet pipe 41, and simultaneously, the fluid medium is output from the pressurizing cylinder 14 to the evaporator 1.

When the outlet valve 21 and the inlet valve 18 are opened (and the inlet valve 20 and the outlet valve 19 are closed), the actuating piston 10 is moved in the opposite direction, by the first pressure of the fluid medium acting on at least one of the remaining actuating pistons 11 and 12, which are moved out of phase 120 degrees with the actuating piston 10. In an alternative embodiment, it is possible to introduce the first pressure of the fluid medium on the opposite side of the pressure receiving surface $S_1$ of the actuating piston 10 to return the actuating piston 10. The pressurizing piston 9 follows the actuating piston 10. Accordingly, the fluid medium is output from the actuating cylinder 15 to the radiator 4 and the fluid medium is drawn from the radiator 1 into the pressurizing cylinder 14. The cycle is then repeated.

It will be understood that it is not necessary to arrange the actuating piston 10 in an opposite relationship with the pressurizing piston 9. Also, the actuating piston 10 may be moved in one direction by the first pressure of the fluid medium acting on the pressure receiving surface $S_1$ against one of the first and second pressures acting on the pressure receiving surface $S_2$.

It is also possible to arrange the crankshaft 13 in a divided form comprising a first rotatable crankshaft portion to which at least the actuating piston 10 is connected, and a second rotatable crankshaft portion to which the pressurizing piston 9 is connected, with a speed changing mechanism interconnecting the first and second crankshaft portions.

Also, while the difference between the temperature of the evaporator 1 and the temperature of the radiator 4 is 25° C. in the above example, it is possible to operate the thermal cycling system even if the difference in temperature is small. For example, it is possible to operate the thermal cycling system even under a temperature difference of 2° to 3° C. and a difference in height of 100 meters. However, it is advisable to design the system so that a frictional loss and a flowing loss are as small as possible.

Also, each of the actuating cylinders 15 to 17 and the pressurizing cylinder 14 is adjustably secured to the casing 30 by a piston position adjusting means 31 for adjusting the position of each piston to the associated cylinder. O-rings are arranged between the cylinders and the casing 30 to hermetically seal the gaps therebetween. The casing 30 has cavities 32 to reduce the weight thereof and is enclosed by an heat insulating material 33. Also, the actuating cylinders 16 and 17 have inner enlarged portions 16' and 17' to ensure a smooth fluid medium flow and the crankshaft 13 has a reinforcement portion 13'.

Also, the casing 30 has a small tube 38 and a corresponding small hole 38' is arranged in a portion of the bearing housing 37; the tube 38 and the hole 38' allow the fluid medium and powder solid lubricant in the crankshaft chamber 30*a* to flow. The tube 38 and the hole 38' may also be used for regulating the pressure in the crankshaft chamber 30*a* to regulate the pressure acting on the piston rings 27 or reduce resistance of the moving elements with accelerations. The tube 38 is connected to the first outlet pipe 42. In the case where the tube 38 is not provided, the pressure in the crankshaft chamber 30*a* is maintained at an intermediate pressure between high and low pressures. Also, a fixing material 39 is filled in the groove that is arranged in the interface between the interconnected piston 9 to 12 and the piston pin 29 and has a cross-sectional area widened with the depth. A fixing material 40 is filled in the groove in the crankshaft 13 at a position of the reinforcement portion 13' after the connecting rods 28 are fitted on the crankshaft 13 to firmly intergrate the crankshaft 13. It is possible to design the slidingly engaging parts such that lubricant oil is not supplied to the engaging parts.

The thermal cycling system can be electronically controlled in response to an output from adequately arranged sensors.

Figure 9:
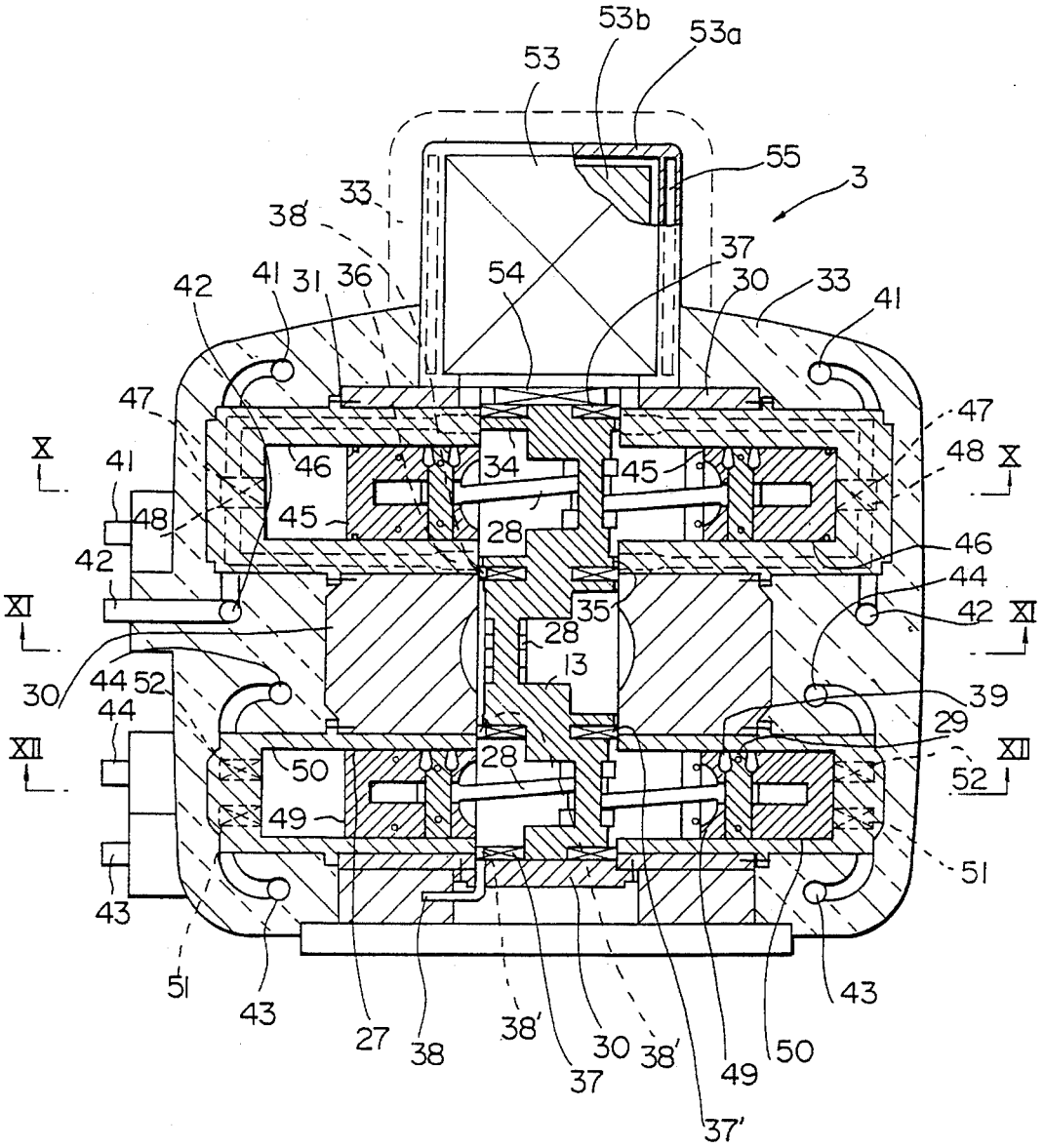
FIG. 9 is a cross-sectional view of the power-free engine of FIG. 2.
Figure 10:
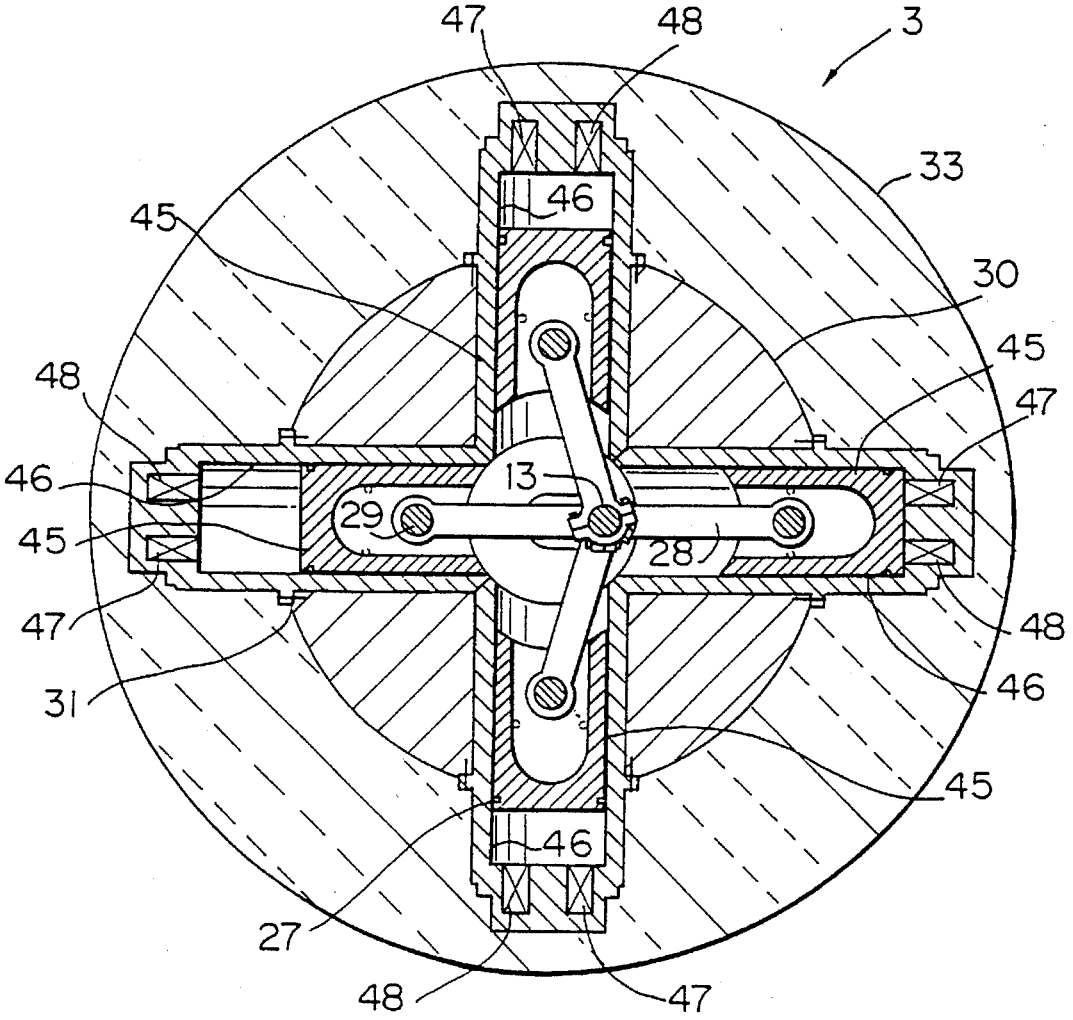
FIG. 10 is a cross-sectional view of the power-free engine of FIG. 9, taken along the line X—X in FIG. 9.
Figure 11:
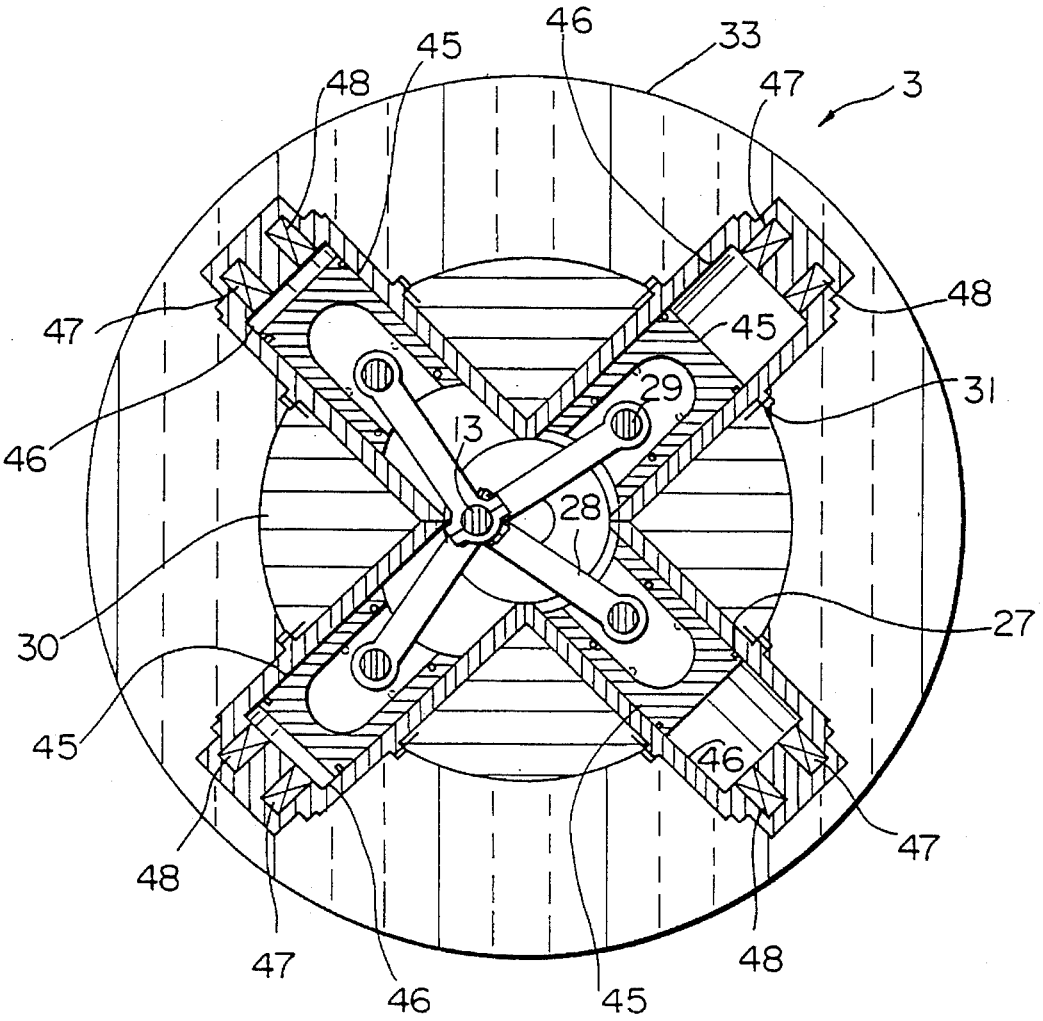
FIG. 11 is a cross-sectional view of the power-free engine of FIG. 9, taken along the line XI—XI in FIG. 9.
Figure 12:
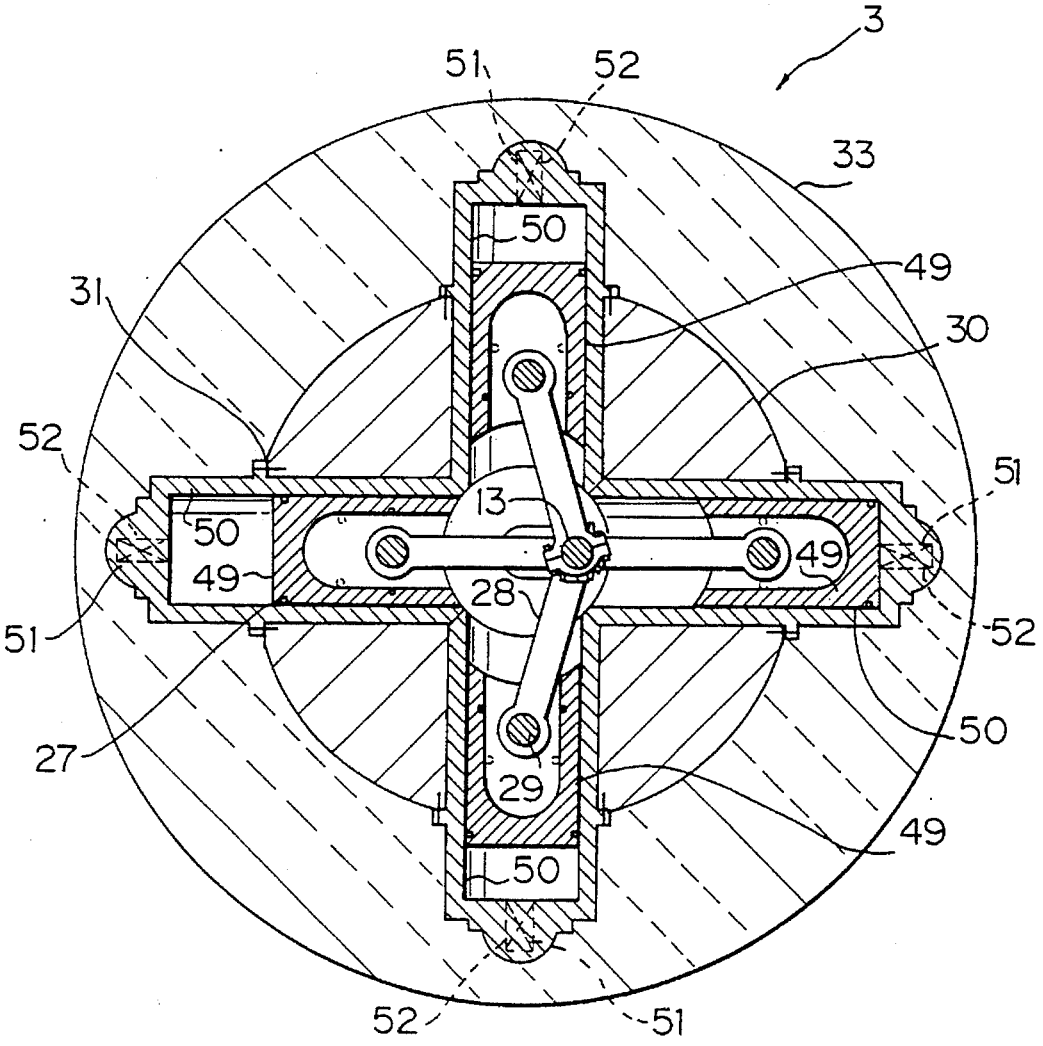
FIG. 12 is a cross-sectional view of the power-free engine of FIG. 9, taken along the line XII—XII in FIG. 9.

FIGS. 9 to 12 show the embodiment of the environmentally powered engine 3 including the generator 53. As shown in FIG. 9, the actuating pistons and the pressurizing pistons are arranged in three stages along the rotation axis of the crankshaft 13. That is, the first stage comprises four actuating pistons 45 accommodated in the respective actuating cylinders 46 and radially arranged about the crankshaft 13, as shown in FIG. 10; the second stage comprises four actuating pistons 45 accommodated in the respective actuating cylinders 46 and radially arranged about the crankshaft 13, as shown in FIG. 11, and the third stage comprises four pressurizing pistons 49 accommodated in the respective pressurizing cylinders 50 and radially arranged about the crankshaft 13, as shown in FIG. 12.

Inlet valves 47 of the actuating cylinders 46 are connected to the first inlet pipe 41, and outlet valves 48 of the actuating cylinders 46 are connected to the first outlet pipe 42. Inlet valves 51 of the pressurizing cylinders 50 are connected to the second inlet pipe 43, and outlet valves 52 of the pressurizing cylinders 50 are connected to the second outlet pipe 44. It will be understood that the actuating pistons 45 and the pressurizing pistons 49 function similarly to the actuating pistons 10 to 12 and the pressurizing pistons 9 in the previous embodiment. Built-up type bearings 37' are used at the central portion of the crankshaft 13.

The generator 53 has a housing 53*a* and a rotor 53*b* housed in the housing 53*a*. The rotor 53*b* is connected to the crankshaft 13 via a speed increasingly changing device 54. The housing 53*a* has a cooling jacket 55 through which the fluid medium is flown.

The engine 3 is designed so that it is adapted to obtain a mechanical output to drive the rotor of the generator 53, rather than merely transferring the heat from a high location to a low location. To this end, the expansion of the gaseous fluid medium powering the engine 3 is 100 percent. This is attained by designing the valve timing such that the inlet valves 47 of the actuating cylinders 46 are closed when the actuating pistons 45 attain a position halfway through their respective strokes. The fluid medium is thus enclosed in the actuating cylinder 46 and expands with the continuous movement of the actuating piston 45, thereby pushing the actuating piston 45 with a large force derived from the expansion. The pressure and the temperature of the fluid medium discharged from the actuating cylinder 46 may become low due to the expansion. The actuating pistons 45 operate every 45 degree angle of the crankshaft 13 and at least one of the inlet valves 47 of the actuating cylinders 46 is always opened. Accordingly, it is possible to restart the engine 3 even if the latter stops at any position. It is also possible to arrange a speed changing device between stages of the actuating cylinders 46 and the pressurizing cylinders 50.

Figure 13:
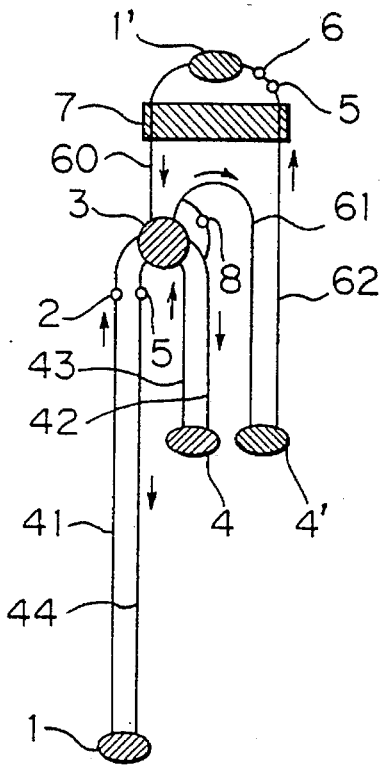
FIG. 13 is a diagrammatic view of a thermal cycling system according to the third embodiment of the present invention, including a sub-cycling system.
Figure 14:
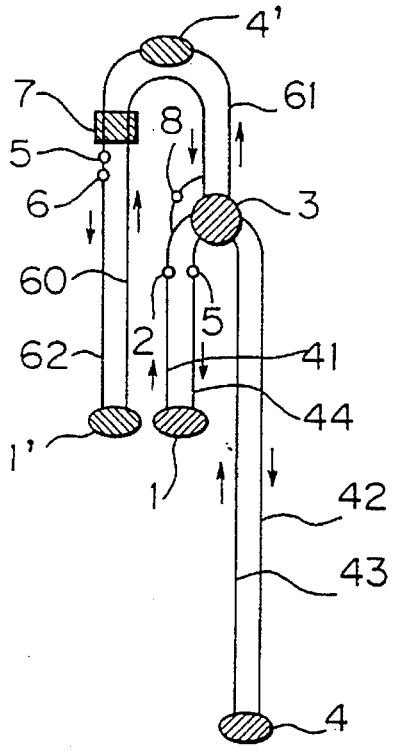
FIG. 14 is a diagrammatic view of a thermal cycling system according to the fourth embodiment of the present invention, including a sub-cycling system.
Figure 15:
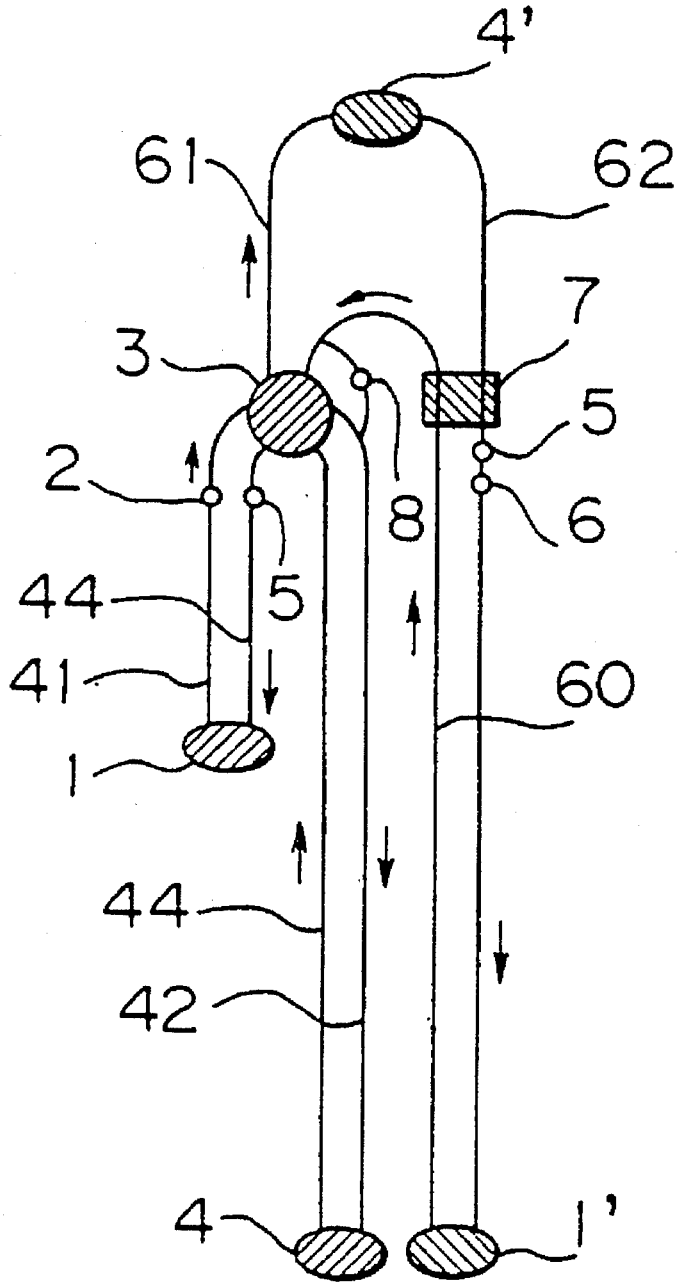
FIG. 15 is a diagrammatic view of a thermal cycling system according to the fifth embodiment of the present invention, including a sub-cycling system.

FIGS. 13 to 15 show the third to fifth embodiments of the present invention, including a sub-thermal cycling system, including at least one sub-pressurizing piston by which a fluid medium circulates through the sub-thermal cycling system. Similar to the previous embodiments of FIGS. 1 and 2, the main thermal cycling system comprises an evaporator 1, a radiator 4, and a engine 3 arranged on the pipes 41 to 44. The engine 3 is shown in FIGS. 16 and 17.

Figure 16:
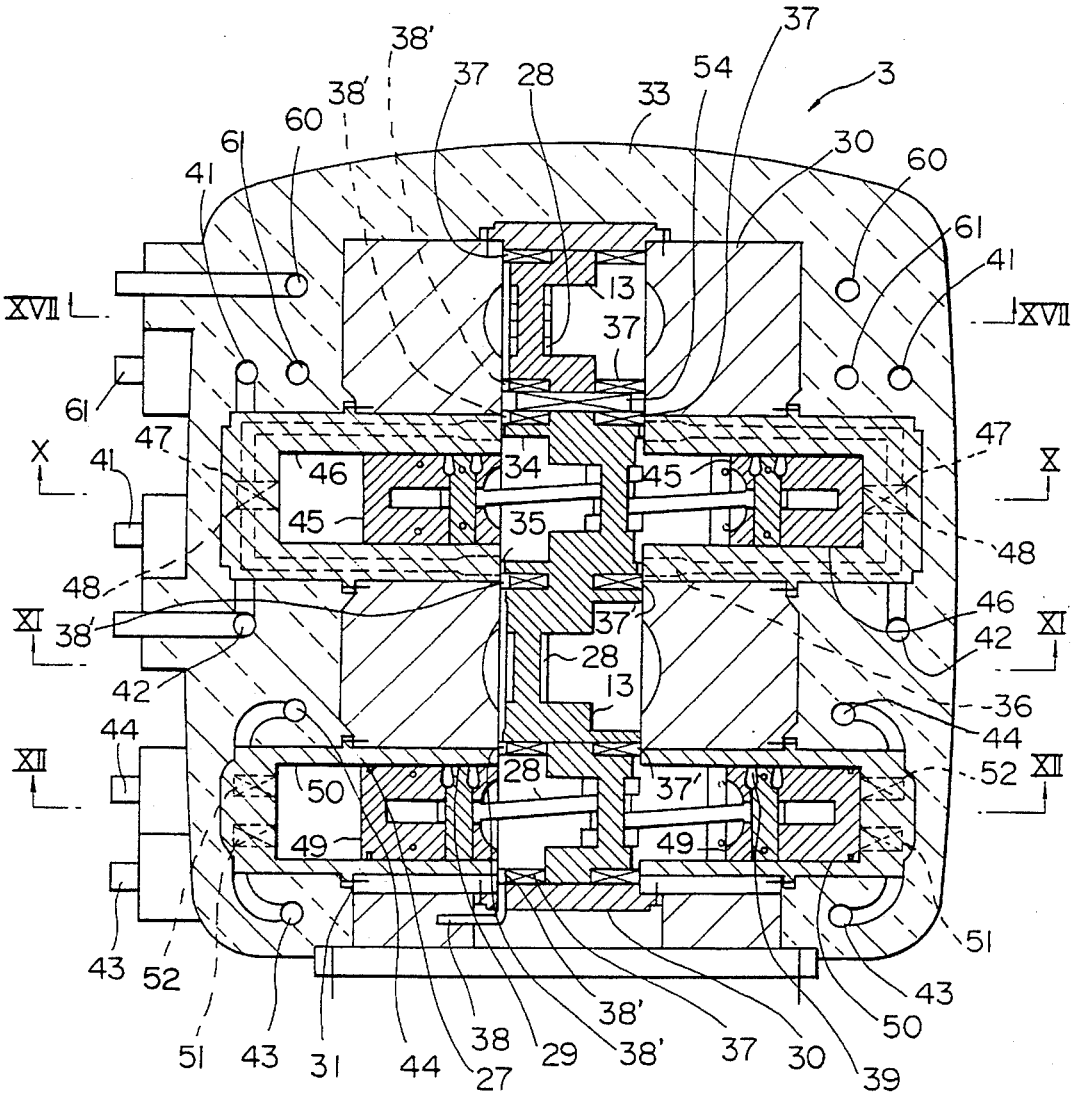
FIG. 16 is a cross-sectional view of the power-free engine of FIGS. 13 to 15.
Figure 17:
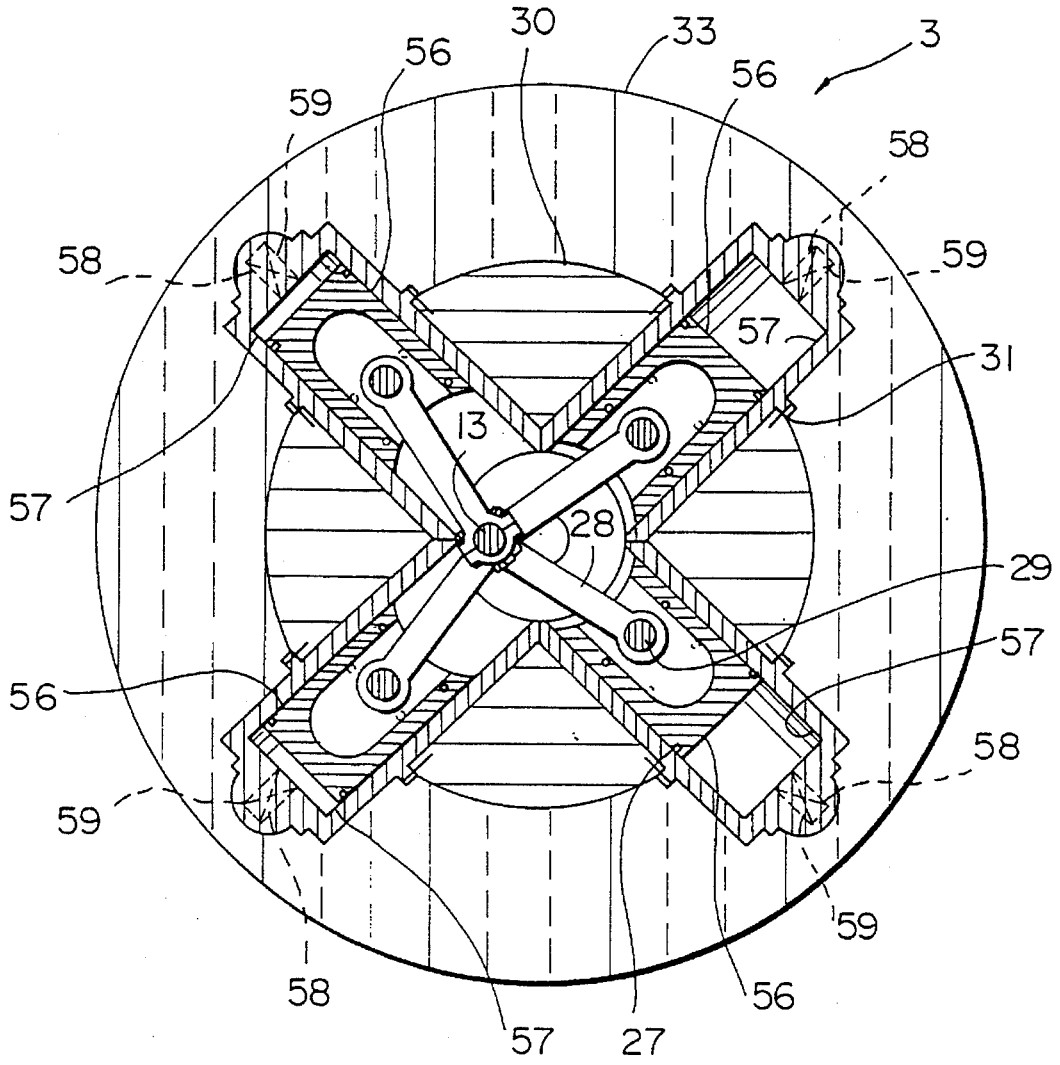
FIG. 17 is a cross-sectional view of the power-free engine of FIG. 16, taken along the line XVII—XVII in FIG. 16.

In FIG. 16, the engine 3 comprises four stages of the actuating pistons and the pressurizing pistons. Section symbols X—X, XI—XI, and XII—XII are given in FIG. 16, to show that these lower three stages include the same actuating pistons 45 and the pressurizing pistons 49 as those of FIGS. 9 to 12. The fourth stage of the engine 3 of FIG. 16 is shown in FIG. 17 and includes sub-pressurizing pistons 56 accommodated in sub-pressurizing cylinders 57. Inlet valves 58 and outlet valves 59 are arranged in the sub-pressurizing cylinders 57, respectively. The inlet valves 58 are connected to a sub-inlet pipe 60 of the sub-thermal cycling system, and the outlet valves 59 are connected to a sub-outlet pipe 61 of the sub-thermal cycling system. It will be understood that the sub-pressurizing pistons 56 are connected to the crankshaft 13 and driven by the actuating pistons 45 of the main thermal cycling system, similar to the generator 53 in FIG. 9.

In FIG. 13, the sub-thermal cycling system comprises an evaporator 1', a radiator 4', and the sub-inlet pipe 60 extending between the evaporator 1' and the engine 3, the sub-outlet pipe 61 extending between the engine 3 and the radiator 4', and a third pipe 62 extending between the radiator 4' and the evaporator 1'. An accessory element 5 and an expansion valve 6 are arranged in the third pipe 62, and a heat exchanger 7 is arranged between the sub-inlet pipe 60 and the third pipe 62.

The sub-pressurizing pistons 56 of the engine 3 compress the fluid medium in the sub-thermal cycling system and deliver the high pressure fluid medium in the radiator 4'. The high pressure fluid medium is delivered from the radiator 4' to the expansion valve 6, which allows the fluid medium to expand and evaporate in the evaporator 1' which thus absorbs heat surrounding it. Accordingly, the air around the evaporator 1' may be cooled. The heat exchanger 7 supercools the fluid medium in the third pipe 62 and superheats the fluid medium in the sub-inlet pipe 60.

A bypass with an associated bypass valve 8 is arranged between the main thermal cycling system and the sub-thermal cycling system for controlling the amount of the circulating fluid medium.

In FIGS. 14 and 15, the sub-thermal cycling system comprises an evaporator 1', a radiator 4', and the sub-inlet pipe 60 extending between the evaporator 1' and the engine 3, the sub-outlet pipe 61 extending between the engine 3 and the radiator 4', and a third pipe 62 extending between the radiator 4' and the evaporator 1'. An accessory element 5 and an expansion valve 6 are arranged in the third pipe 62, and a heat exchanger 7 is arranged between the sub-inlet pipe 60 and the third pipe 62.

As will be apparent from the description of FIG. 13, the temperature around the radiator 4' becomes high while the temperature around the evaporator 1' becomes low. In the embodiments of FIGS. 14 and 15, heat around the evaporator 1' can be used for obtaining hot water or for cooking.

It is possible to arrange the evaporator 1' and the radiator

4' in any height relationship. In FIG. 14, the evaporator 1 of the main sub-thermal cycling system and the evaporator 1' of the thermal cycling system are arranged at the same height level. In FIG. 15, the radiator 4 of the main thermal cycling system and the evaporator 1' of the sub-thermal cycling system are arranged at the same height level. The example of FIG. 15 makes it possible to increase the capacity for cooling the radiator 4 of the main thermal cycling system.

A bypass with an associated bypass valve 8 is arranged between the main thermal cycling system and the sub-thermal cycling system for controlling the amount of circulating fluid medium.

When the system of FIGS. 13 to 15 is applied at a location where the temperature in winter becomes minus 5° C., using a solar energy collector capable of being warmed to 60° C. on the average, and storing the cold of minus 5° C. and the heat of 60° C. it is possible to obtain a refrigerating capacity of 964 MJ at −30° C., a cooking capacity of 618 MJ at 260° to 146° C., obtaining hot water of 1205 MJ at 86° C., or generating a capacity of 72 kwh, per square meters of the collector during one year. When the system is used for a room air conditioning system, it is possible to save energy converted in 113 liters of crude petroleum, which includes 224 kwh of electric power, per square meter of the collector in one year, thus it is possible to obtain a large amount of clean energy, using a harmless fluid medium that does not adversely affect the ozone layer, thereby saving electric power, reducing carbon dioxide, a sulfur dioxide, and nitrogen dioxide in the atmosphere, and preventing acid rain.

As explained in greater detail, according to the present invention, it is possible to transfer heat available in the environment such as a solar energy, atmospheric energy, heat discharged from various apparatuses, heat from furnaces, underground heat, or heat obtained by wind or water, without using electric power. It is also possible to operate the thermal cycling system even under a temperature difference of 2° to 3° C. and a height difference of 100 meters between high and low locations. It is also possible to transfer heat for cooling, heating, obtaining hot water or cooking, or to drive a generator. In this case, it is possible to heat an object to 300° C. and to cool an object to −90° C.

I claim:

1. A system for thermally cycling a compressible fluid medium contained in the system, comprising:

an evaporator for evaporating and heating the fluid medium in the system to a first temperature and a first pressure;

a radiator coupled to the evaporator for radiating the heat of the fluid medium in the system to a second temperature lower than the, first temperature and a second pressure lower than the first pressure;

at least three actuating cylinders coupled to the evaporator and the radiator each having an inlet valve and an outlet valve in an end thereof;

an actuating piston disposed in each of the actuating cylinders having a pressure receiving surface $S_1$;

at least one pressurizing cylinder coupled to the evaporator and the radiator having an inlet valve and an outlet valve in an end thereof;

a pressurizing piston disposed in said pressurizing cylinder having a pressure receiving surface $S_2$, wherein $S_2$ has a smaller cross sectional area than $S_1$ such that the total volume of the at least three actuating cylinders is greater than the total volume of the at least one pressurizing cylinder, rotatable body means operatively coupled to the at least three actuating pistons and the at least one pressurizing piston;

a first inlet pipe having one end connected to the evaporator and another end connected to each of the at least three actuating cylinders;

a first outlet pipe having one end connected to each of the at least three actuating cylinders and another end connected to the radiator;

a second inlet pipe having one end connected to the radiator and another end connected to the at least one pressurizing cylinder;

a second outlet pipe having one end connected to the at least one pressurizing cylinder and another end connected to the radiator; and a flow control valve arranged on the first inlet pipe, wherein at least one of the actuating cylinder inlet valves is open when the flow control valve is open.

2. The thermal cycling system according to claim 1, wherein the rotatable body means comprises a rotatable crankshaft having a rotation axis, and the at least three actuating pistons and the at least one pressurizing piston are connected to the crankshaft.

3. The thermal cycling system according to claim 1, wherein the rotatable body means comprises a first rotatable crankshaft to which the at least three actuating pistons are connected, a second rotatable crankshaft to which the at least one pressurizing piston is connected, and a speed changing mechanism interconnecting the first and second crankshafts.

4. The thermal cycling system according to claim 2, wherein the at least three actuating pistons comprise a plurality of actuating pistons accommodated in actuating cylinders, respectively; one of the actuating pistons being moved in one direction by the first pressure of the fluid medium acting on said one actuating piston, and in the opposite direction by the first pressure of the fluid medium acting on at least one other of the actuating pistons.

5. A thermal cycling system according to claim 4, wherein the plurality of actuating pistons are arranged equiangularly about the rotation axis of the crankshaft means.

6. A thermal cycling system according to claim 4, wherein one of the actuating pistons has a first cross-sectional area and at least one pressurizing piston has a second cross-sectional area smaller than the first cross-sectional area.

7. A thermal cycling system according to claim 4, wherein the actuating pistons are arranged in multiple stages along the rotation axis of the crankshaft; each stage including a plurality of equiangularly arranged actuating pistons.

8. A thermal cycling system according to claim 7, wherein the actuating pistons and at least one pressurizing piston are arranged in multiple stages along the rotation axis of the crankshaft.

9. A thermal cycling system according to claim 4, wherein the system further comprises a casing having a central crankshaft chamber to accommodate the crankshaft means therein; the actuating cylinders and at least one pressurizing cylinder being radially arranged about the rotation axis of the crankshaft means and having respective inner ends and outer ends; the inlet and outlet valves of the actuating cylinders and at least one pressurizing cylinder being provided in the outer ends of the cylinders, respectively; the inner ends of the cylinders being in communication with the central crankshaft chamber.

10. A thermal cycling system according to claim 9, wherein each of the actuating cylinders and at least one pressurizing cylinder is adjustable secured to the casing.

11. A thermal cycling system according to claim 1, wherein a ratio of a stroke volume per time of at least one actuating piston to that of at least one pressurizing piston is determined so that the gaseous fluid medium can be drawn from the radiator into at least one pressurizing cylinder.

12. A thermal cycling system according to claim 1, wherein the fluid medium absorbs heat at a temperature above the evaporation temperature of a wet gas when entropy of the cycle is increasing in the evaporator.

13. A thermal cycling system according to claim 1, wherein the rotatable body means has a mass sufficient to cause at least one actuating piston and at least one pressurizing piston to smoothly repeat the movement in said one and opposite directions.

14. A thermal cycling system according to claim 1, wherein the system includes a further working means actuated by the rotatable body means.

15. A thermal cycling system according to claim 14, wherein the further working means comprises a generator having a rotor connected to the rotatable body means.

16. A thermal cycling system according to claim 15, wherein the generator comprises a housing having a cooling jacket through which the fluid medium is flown.

17. A thermal cycling system according to claim 14, wherein the further working means comprises a sub-thermal cycling system including at least one sub-pressurizing piston by which a fluid medium circulates through the sub-thermal cycling system.

18. A thermal cycling system according to claim 17, wherein the sub-thermal cycling system comprises a cooling system.

19. A thermal cycling system according to claim 17, wherein the sub-thermal cycling system comprises a heating system.

20. A thermal cycling system according to claim 17, wherein a bypass with an associated bypass valve is arranged between the main thermal cycling system and the sub-thermal cycling system for controlling the amount of circulating fluid medium.

21. A thermal cycling system according to claim 1, wherein the system further includes at least one of, a receiver tank, an expansion valve, a heat exchanger, a filter, a purger of non-condensible gas, a drier, a shut-off valve, a safety valve, a window, and a service valve.

22. A thermal cycling system according to claim 1, wherein the system is electronically controlled in response to an output from adequately arranged sensors.

23. A thermal cycling system according to claim 1, wherein the system includes slidingly engaging parts designed such that the engaging parts are comprised of the oil-less materials.

24. A thermal cycling system according to claim 1, wherein the system includes slidingly engaging parts to which a solid lubricant is supplied.

25. The thermal cycling system of claim 1 in which the other end of the first inlet pipe is connected to the at least three actuating cylinder inlet valves; the one end of the first outlet pipe is connected to the at least three actuating cylinder outlet valves; the other end of the second inlet pipe is connected to the at least one pressurizing cylinder inlet valve; and the one end of the second outlet pipe is connected to the at least one pressurizing cylinder outlet valve.

* * * * *